United States Patent [19]

Culbertson

[11] 4,141,412

[45] Feb. 27, 1979

[54] AIR-TO-AIR HEAT RECUPERATING UNIT

[76] Inventor: Donald L. Culbertson, Mountain Lakes, N.J.

[21] Appl. No.: 762,881

[22] Filed: Jan. 27, 1977

[51] Int. Cl.[2] ..... F28F 3/08
[52] U.S. Cl. ..... 165/166
[58] Field of Search ..... 165/166, 167

[56] References Cited

U.S. PATENT DOCUMENTS

| | | | |
|---|---|---|---|
| 1,805,652 | 5/1931 | Caracristi | 165/166 |
| 2,566,310 | 9/1951 | Burns et al. | 165/167 X |
| 3,106,242 | 10/1963 | Jenssen et al. | 165/166 |
| 3,783,090 | 1/1974 | Andersson et al. | 165/166 |

FOREIGN PATENT DOCUMENTS

| | | | |
|---|---|---|---|
| 774760 | 9/1939 | France | 165/166 |

*Primary Examiner*—Albert W. Davis, Jr.

[57] ABSTRACT

A heat exchanger comprising a plurality of spaced sheets and a plurality of adjacent channels between successive layers of said sheets for the passage of air or other gases. Spacers are installed between successive layers for rigidly maintaining said sheets and for defining said channels, and splitters are mounted between adjacent channels for guiding the air flow from one channel to the next adjacent channel. The heat exchanger sheets are impressed with a unique pattern designed to further improve the heat transfer efficiency of the heat exchanger and to impart structural integrity to the assembly.

19 Claims, 15 Drawing Figures

1
3
5
7
23
25
27
29
31
33
35
4
4

AIR-TO-AIR HEAT RECUPERATING UNIT

BACKGROUND OF THE INVENTION

1. Field of Invention

This invention relates generally to heat exchangers and is particularly related to gas-to-gas heat recuperating apparatus. More specifically, the present invention relates to an air-to-air heat recuperating system comprising a plurality of stacked, spaced parallel flow channels uniquely designed and arranged to realize maximum heat transfer between flowing gas streams efficiently and economically.

2. The Prior Art

A variety of heat exchangers and heat recovery units have been available for years and some have been used in various industrial installations. Some of these heat exchangers are of the shell-and-tube variety where one fluid stream is passed through the shell and the other through tube, concurrently or countercurrently. Various design modifications such as the provision of finned tubes promotes turbulance and maximizes heat transfer between the two fluid streams.

Other heat recovery installations employ a heat exchanger system comprising a plurality of stacked tubes through which one of the fluid streams is passed while the other fluid stream flows across the tubes, usually at 90 degrees relative to the direction of fluid flow in the tubes. See, e.g., U.S. Pat. No. 2,296,570.

It is aximoatic, however, that in heat exchanger design, the desideratum is to maximize heat transfer efficiency of the unit while minimizing the cost of its utilization and operation in a particular installation. Additionally, while the shell-and-tube type heat exchangers are useful in some installations, there are other installations in which these exchangers cannot be conveniently integrated into the system, nor can they be used and operated efficiently and ecconomically. The use of heat exchangers comprising a plurality of stacked tubes offers a convenient alternative, and it is with this type of heat recovery unit that the present invention is particularly concerned.

Although some stacked tubes heat exchanger units have been designed and proposed by some of the prior art workers in this field, their poor heat transfer efficiency and high cost of operation has severely limited their practical industrial utilization. For example, the aforementioned U.S. Pat. No. 2,296,570 describes a cooling apparatus designed for a particular application (aeroplanes) and comprises a plurality of thin flat tubes through which so-called thin "strips" of compressed air flows from one end to the other end of the tubes, while cool air is passed across the surface of the tubes for cooling the compressed air flowing through the tubes.

In another more recent patent (U.S. Pat. No. 3,627,039), the heat exchanger comprises a plurality of pipes or tubes arranged axially parallel in several planes (stacks), one above or adjacent the other, and the respective ends of the tubes are combined to a common respective inlet and outlet apertures. The fluid medium to be cooled or heated enters through the inlet aperture, flows through the tubes and leaves through the outlet aperture, and the second fluid medium, which is used to cool or heat the fluid medium flowing through the tubes, is passed externally along the tubes laterally in a counterflow manner.

The prior art stacked, multiple tubes heat exchangers are usually expensive to operate due to their poor heat transfer efficiency and large pressure drop requirement. Their use, therefore, has been limited to particular systems where economic restrictions do not preclude their consideration. Economic demands in most systems, however, necessitate consideration and utilization of heat exchange units which exhibit superior heat transfer efficiency, lower pressure drop requirements and hence more economical operation. Thus, for numerous installations, there is still a need for a heat exchanger which can be conveniently integrated into the installation and used efficiently and more economically.

SUMMARY OF THE INVENTION

In accordance with this invention, a heat exchanger is provided which is more efficient and more economical to operate than the prior art stacked heat exchangers. It comprises a plurality of spaced substantially parallel sheets and a plurality of adjacent channels between successive layers of said sheets for the passage of air or other gases. The heat exchanger also comprises a plurality of spacer members installed axially between successive layers for rigidly maintaining said sheets and for defining said channels. Additionally splitters are mounted between adjacent channels for guiding the air flow from one channel into the next adjacent channel.

In one specific embodiment of this invention each sheet is impressed with a unique pattern designed to promote the heat transfer efficiency of the exchanger and to impart structural integrity to the unit.

In still another and more specific embodiment of the invention, the design of the heat exchanger contemplates the provision of a plurality of staggered arrangement of so-called "standoff" members in order to impart additional structural rigidity to the sheets and to promote turbulence and further improve the heat transfer efficiency between the flowing air streams.

The foregoing and other features of this invention will now be explained in more detail in the ensuing description of the preferred embodiment of the invention taken in conjunction with the accompanying drawings.

DESCRIPTION OF THE PREFERRED EMBODIMENT OF THE INVENTION

Figures 1, 2, 5, 9, 10, 11, 12, 13:
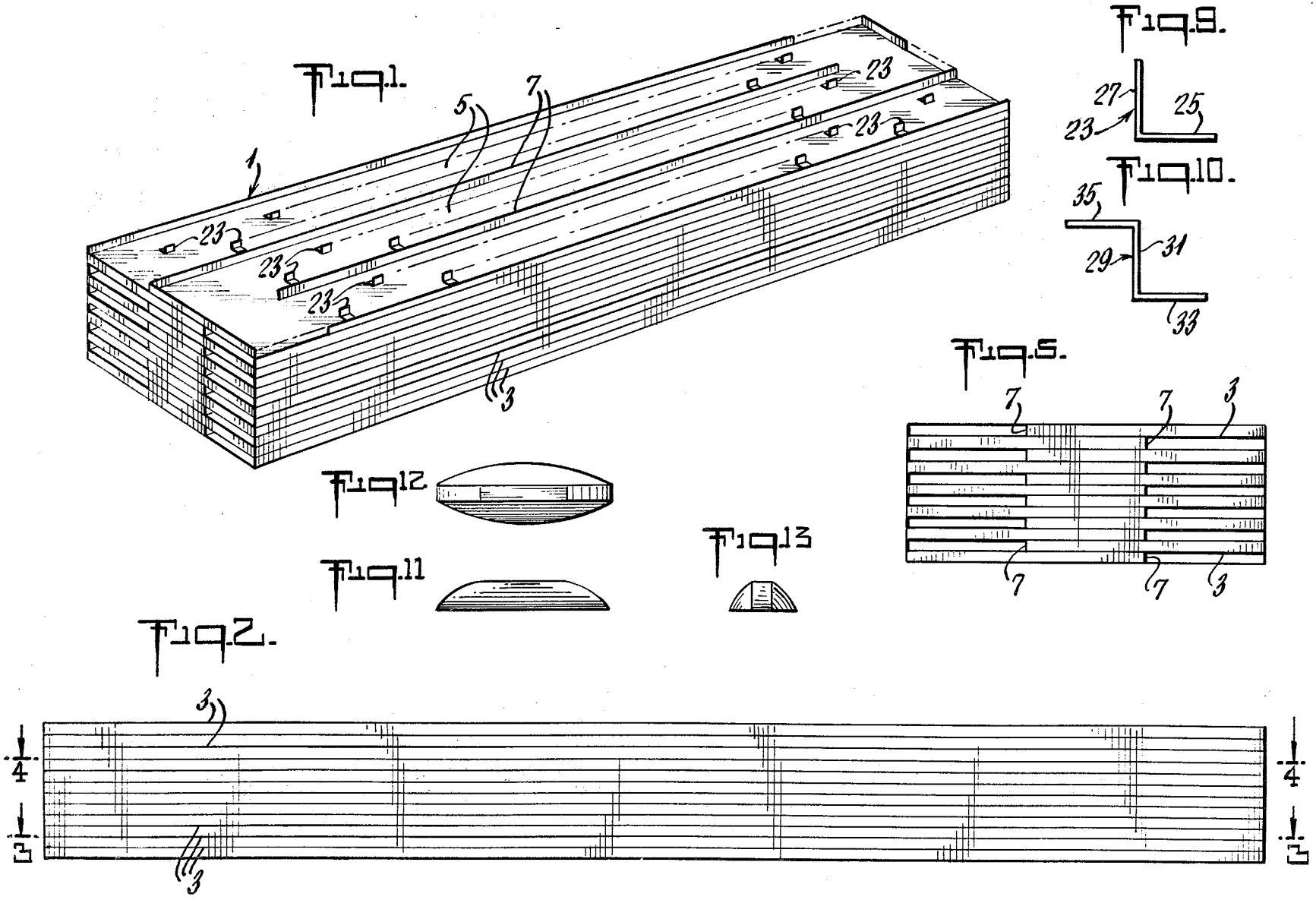
FIG. 1 is a perspective view of a heat exchanger constructed in accordance with this invention.
FIG. 2 is a longitudinal front view of the heat exchanger shown in FIG. 1, illustrating the stacked layout of the heat exchanger tubes and sheets.
FIG. 5 is an end elevational view of the heat exchanger shown in FIG. 1.
FIG. 9 is a front elevational view of a typical standoff member which is mounted on the heat exchanger sheets as illustrated in FIG. 1.
FIG. 10 is a front elevational view of another type of standoff member.
FIG. 11 is a side view of a unit pattern on a plate from which the unique sheet patterns are obtained.
FIG. 12 is a top view of the pattern shown in FIG. 11.
FIG. 13 is an end view of the pattern shown in FIG. 11.

Referring now to the drawings wherein like reference numerals designate like parts, and with particular reference to FIG. 1, there is shown a heat exchanger generally designated by the numeral 1 comprising a plurality of spaced sheets 3 arranged axially in a generally parallel relationship to each other, and a plurality of adjacent channels or tubes 5 between successive layers of the sheets 3. The number of the tubes 5 between successive pairs or layers of the sheets 3 may vary according to the formula 1+n where n is an even integer, say, for example, 2,4,6,8, etc., in which case the corresponding number of tubes 5 between the successive pair of sheets 3 will be 3, 5, 7, 9, etc., respectively. As a practical matter of construction and economy of operation of the heat exchanger of this invention three tubes per stack are all that is necessary, although greater numbers of tubes (i.e., 5, 7, 9, etc.) may be used for some installations if necessary or desirable.

Figure 3:
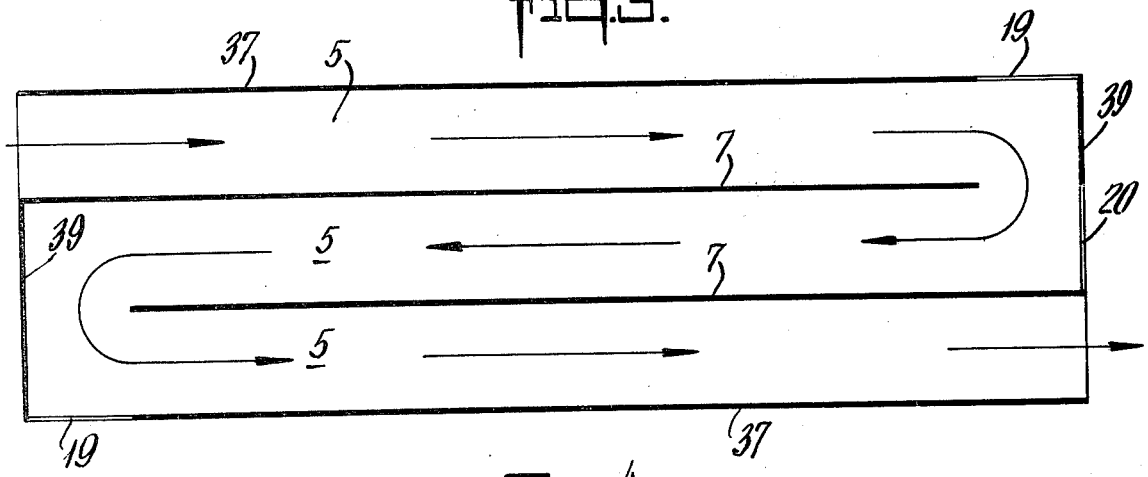
FIG. 3 is a plan view taken along the line 3—3 of FIG. 2.
Figure 4:
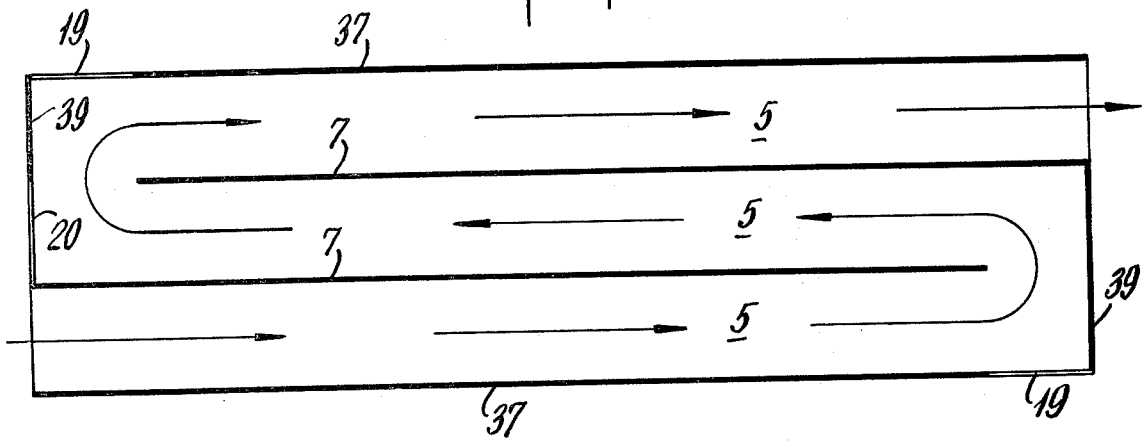
FIG. 4 is a plan view taken along the line 4—4 of FIG. 2.

The heat exchanger 1 also comprises a plurality of spacer members 7 which serve to maintain the sheets 3 in spaced, parallel rigid position and which also define the adjacent tubes 5 between successive layers of the sheets 3 in the heat exchanger. Each spacer member 7 is a generally flat metal part bar which is a fraction of an inch thick and which in the most preferred construction of the heat exchanger is approximately one inch high, although this height may vary depending on the desired spacings of the sheets. Each spacer members 7 is welded along its lower edge on the upper surface of each sheet 3 while the lower surface of the next higher sheet rests snugly against the upper edge of the spacer member thus providing a plurality of rigidly spaced sheets. As shown in FIGS. 3 and 4, each spacer member 7 is shorter than the sheets 3 and is arranged so that one end of the spacer member is coterminous with the sheet on which it is welded while the other end extends a distance away from the opposite end of that sheet, and this spacer arrangement is alternated so as to define a substantial clearance between each two adjacent tubes at opposite ends of the sheets for mounting the so-called "splitters" as will hereinafter be described.

It has been found that the pressure drop in the heat exchanger can be decreased when this clearance is about the same as the width of the tubes. Increase or decrease in the width of this clearance generally result in some increase in the pressure drop.

In the preferred construction of the heat exchanger 1, several conveniently available stocks of 4 ft. wide metal are divided into three tubes 5 of substantially equal width by the spacer members 7 as shown in FIGS. 3 and 4 and the sheets are stacked as shown in FIGS. 1 and 2. The exact length of each tube may vary and generally depends on the percent heat recovery required for a particular installation. While in this preferred construction only three tubes are employed between successive pairs of sheet, more than three tubes may be employed by simply installing additional spacers.

Thus the bottom stack in FIG. 2, the plan view of which is illustrated in FIG. 3, comprises three tubes for the passage of one of the air streams, say, the cold air stream, and the next adjacent stack in FIG. 2, the plan view of which is shown in FIG. 4, comprises three tubes for the passage of the other air stream, i.e., the hot air stream substantially in the same and parallel direction relative to the flow of the cold air stream.

Thus, in the heat exchanger construction described herein, and as is shown in FIGS. 3 and 4, the cold air stream enters at one end of the heat exchanger, flows through the tubes 5 in the bottom stack, and each alternate stack thereafter, and leaves the heat exchanger at diagonally opposite end relative to its point of entry, while the hot air stream enters the heat exchanger at the same end at the next higher stack, and each alternate stack thereafter, flows through the tubes 5 in those stacks and leaves the exchanger at diagnoally opposite end from its point of entry. This relative flow pattern of the respective air streams affords optimum heat transfer efficiency in the exchanger, and as many stacks may be employed as is necessary to handle the air flow through the exchanger.

Gas-to-gas heat exchangers are usually operated at gas velocities of 300 to 4000 standard feet per minute, with operation at the higher velocities being more desirable due to increased heat transfer efficiency which permits the selection and design of more compact and smaller heat exchangers. The heat exchanger of this invention is uniquely designed to accomodate gas velocities of from about 2000 to 4000 standard feet per minute and hence exhibits improved heat transfer efficiency.

As it was previously mentioned, the two most significant considerations in the design of heat exchangers for any installation are heat transfer efficiency and pressure drop. The higher the pressure drop, the higher the power, and hence the higher energy required to handle a given volume of air in the exchanger. Also, the lower the heat transfer efficiency, the larger the surface area and hence the size of the heat exchanger which is required.

It has been discovered that unless the various stacks of the sheets 3 are adequately spaced the pressure drop in the exchanger will be significantly increased and that a spacing of from about 0.5 to about 1.5 inch, preferably from about 0.75 to about 1.25 inch optimizes the balance between pressure drop and heat transfer. Thus the height of the spacer members 7 can vary from about 0.5 to about 1.5 inch and preferably from about 0.75 to about 1.25 inch which corresponds to the relative spacings between successive pairs of sheets in each stack.

Figure 8:
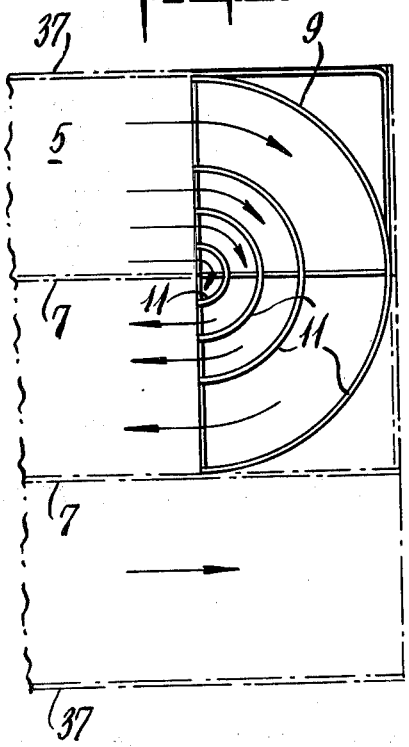
FIG. 8 is a plan view of the splitter mounted between adjacent channels in the heat exchanger.

In order to further reduce the pressure drop through the heat exchager, so-called "splitters" 9 are removably mounted between each two adjacent tube 5, alternately at opposite ends of the heat exchanger as shown in FIG. 8. Each splitter 9 comprises a plurality of generally concentric semi-circular members 11 which can be made by bending a series of flat, thin metal bars and welded at their respective ends to the horizontal member 13 and at their middle to the vertical cross member 15 as shown in FIG. 8. The splitter 9 may be conveniently provided with an integral handle (not shown) which may be readily gripped by the hand for slidably inserting the splitter 9 through access ports 19.

Thus, the splitter 9 comprises a pluarlity of flow-guiding channels 21, defined by the semi-circular members 11, through which air flows from one tube to the next adjacent tube in a substantially laminar fashion.

The incorporation of the spacers 7 and the splitters 9 constitute unique features in the design and construction of the heat exchanger of this invention. The provision of the splitters 9 reduces the pressure drop through the tubes 5, while the incorporation of the spacers 7 as aforesaid imparts structural integrity to the unit, improves the heat transfer efficiency between the two air streams and hence affords higher heat recovery in this system.

In order to further improve the heat transfer efficiency of the heat exchanger, so-called "standoff" members 23 are mounted on each sheet in a staggered fashion as shown in FIGS. 1 and 9. Each standoff member is a generally angular member defined by a generally horizontal portion 25 which is welded on the upper surface of the sheets 3 and an integral, generally upright portion 27 which rests snugly against the lower surface of the next higher sheet in each stack. The height of the upright portion 27 of each standoff member 23 is approximately the same as the height of the spacer members 7, and thus it prevents the sheets from buckling and collapsing, hence imparting more rigidity and added structural integrity to the exchanger.

In order to impart more structural integrity to the heat exchanger sheets, the standoff member may be a generally Z-shaped member 29 as shown in FIG. 10 which is defined by a generally upright portion 31 and an integral spaced generally horizontal portions 33 and 35. The generally horizontal portion 33 rests snugly against the lower surface of the next higher sheet in the stack and hence provides lateral support which prevents the sheets from buckling or fracture.

The provision of the standoff members as aforesaid not only rigidizes the structure but also improves the heat transfer efficiency of the exchanger without significant increase in pressure drop through the tubes.

The heat exchanger 1 is also provided with a plurality of side rails or panels 37 and end rails or panels 39 between successive sheets in order to define an enclosure for the heat exchanger assembly. The side panels 37 and panels 39 are welded along both of their edges to the heat exchanger sheets such that the external surface of the panels are generally flush with the sides and ends of the heat exchanger sheets.

As is shown in FIGS. 3 and 4, the side panels 37 extend from one end of the heat exchanger to the access ports 19 at the other end of the exchanger, while the end panels 39 provide a partial enclosure at the ends of the heat exchanger so as to provide access ports 20 at alternate ends of the heat exchanger to provide access to the central channel in each stack.

In a more specific embodiment of this invention the sheets 3 are impressed on both sides with a unique pattern as shown in FIGS. 6, 7A, 7B and 7C designed to further increase the heat transfer efficiency of the exchangers and to rigidize the several sheets or stacks in order to impart more structural stability to the unit.

Figure 7A:
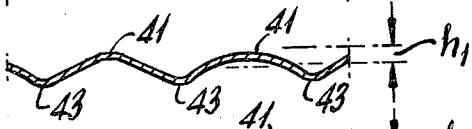
FIG. 7A is a view taken along the line A—A of FIG. 6.
Figure 7B:
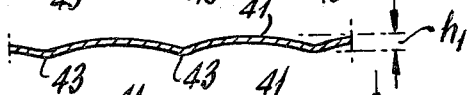
FIG. 7B is a view taken along the line B—B of FIG. 6.
Figure 7C:
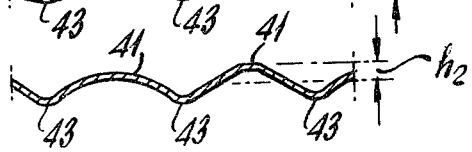
FIG. 7C is a view taken along the line C—C of FIG. 6.

The patterns on the sheets are obtained by taking two plates having regularly repeating elepto-trapezoidal pattern as shown in FIGS. 11, 12 and 13, having protrusions and corresponding depressions or valleys between each two elepto-trapezoidal units. The plates are then placed in a suitable press, offset relative to each other so that the protrusions in one plate nest in the corresponding valleys of the other plate in an offset manner. The heat exchanger sheet is then placed between said plates, the press is closed and stamped to transfer the resulting pattern to the sheets as shown in FIG. 6.

Where the sheets 3 are impressed with a pattern as hereinbefore described, the surface of these sheets will exhibit the protrusions 41 and depressions 43 as shown in FIGS. 7A, 7B and 7C. The depth of the protrusions ($h_1$) and the depth of the valleys ($h_2$) must be at least 0.03 inch, and preferably between about 0.045 and 0.06 inch in order to achieve optimum heat transfer efficiency.

Also, it must be noted that where the sheets 3 are impressed with said unique pattern, these patterns do not extend to the area where the splitters are mounted nor do they extend to the railings which provide the enclosure for the heat exchangers. Additionally, these patterns do not extend to the area where the spacers are mounted.

Figure 6:
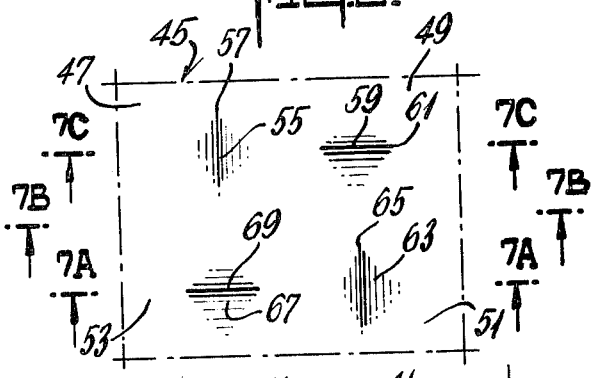
FIG. 6 is a plan view of a regularly repeating unit of the pattern which is impressed on the heat exchanger sheets.

Referring now to FIG. 6, there is shown the repeating pattern of the sheets 3 consisting of a particularly shaped square 45 having indented and protruding portions when viewed from either side of the heat exchanger sheet. Thus, the square 45 comprises four sub-squares 47, 49, 51 and 53, a first elongated protrusion 55 having a centerline 57, a second elongated protrusion 59 having a centerline 61 generally perpendicular to said centerline 57 and spaced therefrom a distance of about one-half the length of said first elongated protrusion 55. The square 45 also comprises a third elongated protrusion 63 having a centerline 65 which is generally perpendicular to said second elongated protrusion 59 and spaced therefrom about one-half the length of said second elongated protrusion, a fourth elongated protrusion 67 having a centerline 69 which is generally perpendicular to the centerline 65 of the third elongated protrusion 63 and spaced therefrom about one-half the length of said elongated protrusion, and, wherein said fourth elongated protrusion is spaced from said first elongated protrusion a distance of one-half of the length of said first elongated protrusion.

Each of the elongated protrusions 55, 59, 63 and 69 form the bisectors of the respective sub-squares 47, 49, 51 and 53.

The novel heat exchanger layout and design described herein is practically suitable for all temperature ranges, and may be fabricated from a variety of metal such as, for example, aluminum, low carbon steel, high strength steel, aluminized steel as well as stainless steel.

It is evident from the foregoing detailed description of the invention that several changes and modifications can be made in the design of the heat exchanger which are obvious from said description and the drawings, and hence fall within the scope and purview of this invention. Also, while the heat exchanger has been described for the purpose of illustration in connection with heat exchange between two air streams, it must be understood that such description is not intended to limit its application since other gas media, including corrosive vapors may be substituted for one or both air streams.

What is claimed is:

1. In a metal heat transfer sheet for use in stacking relative to each other in the construction of multiple stack heat exchanger, a sheet metal member indented and protruded with a repeated pattern, wherein each portion of the pattern is a repetition of a particularly shaped square comprising four sub-squares having indented and protruding portions as viewed from either side of the sheet; each of said squares comprising a series of indentations and protrusions in the form of a first elongated protrusion having a first centerline; a second elongated protrusion having a second centerline perpendicular to said first centerline of said first protrusion and spaced therefrom about one-half the length of said first protrusion; a third elongated protrusion having a third centerline which is perpendicular to said second centerline of said second protrusion and spaced therefrom about one-half the length of said second protrusion; a fourth elongated protrusion having a fourth centerline which is perpendicular to said third centerline of said third protrusion and spaced therefrom by about one-half the length of said third protrusion; and wherein said fourth centerline is spaced from said first centerline by about one-half the length from said first protrusion and wherein each of said elongated protrusions form the bisectors of one of the said subsquares.

2. A heat exchanger comprising a plurality of juxtaposed, substantially parallel sheets defining successive passageways between each pair of said sheets, spacer members between successive pairs of said sheets for maintaining said heat exchanger in rigid position and for dividing each of said passageways into n+1 adjacent channels wherein n is an even integer between 2 and about 10, said successive passageways being provided for the flow of two gas streams with each of said gas streams flowing through an alternate passageway and wherein each of said gas streams enter its respective passageway through the end walls at opposite corners of the same end of said heat exchanger, flow through said channels in each of said passageways in the same and substantially parallel direction and leave the heat exchanger through the other end wall at diagonally opposite ends of said heat exchanger.

3. A heat exchanger as in claim 2 wherein n is 2.

4. A heat exchanger as in claim 3 further including splitter members mounted between each two of said adjacent tubes at alternately opposite ends of said sheets, each of said splitter members comprising a plurality of concentric, semicircular members defining a plurality of flow paths between said plurality of concentric, semi-circular members.

5. A heat exchanger as in claim 4 wherein each successive pair of said sheets are spaced at a distance of from about 0.5 to about 1.5 inch.

6. A heat exchanger as in claim 5 further comprising a plurality of regularly staggered angular members, each of said members comprising a generally horizontal portion securely mounted on each of said sheets and an integral, generally upright portion which rests snugly against the next higher sheet.

7. A heat exchanger as in claim 4 further comprising a plurality of regularly staggered angular members, each of said members comprising a generally horizontal portion securely mounted on each of said sheets and an integral, generally upright portion which rests snugly against the next higher sheet.

8. A heat exchanger as in claim 3 wherein each successive pair of said sheets are spaced at a distance of from about 0.5 to about 1.5 inch.

9. A heat exchanger as in claim 8 further comprising a plurality of regularly staggered angular members, each of said members comprising a generally horizontal portion securely mounted on each of said sheets and an integral, generally upright portion which rests snugly against the next higher sheet.

10. A heat exchanger as in claim 3 further comprising a plurality of regularly staggered angular members, each of said members comprising a generally horizontal portion securely mounted on each of said sheets and an integral, generally upright portion which rests snugly against the next higher sheet.

11. A heat exchanger as in claim 3 wherein said sheets are impressed with regularly repeating patterns, wherein each portion of the pattern is a repetition of a particularly shaped square comprising four sub-squares having indented and protruding portions as viewed from either side of the sheet; each of said squares comprising a series of indentations and protrusions in the form of a first elongated protrusion having a first centerline; a second elongated protrusion having a second centerline perpendicular to said first centerline of said first protrusion and spaced therefrom about one-half the length of said first protrusion; a third elongated protrusion having a third centerline which is perpendicular to said second centerline of said second protrusion and spaced therefrom about one-half the length of said second protrusion; a fourth elongated protrusion having a fourth centerline which is perpendicular to said third centerline of said third protrusion and spaced therefrom by about one-half the length of said third protrusion; and wherein said fourth centerline is spaced from said first centerline by about one-half the length from said first protrusion and wherein each of said elongated protrusion form at the bisectors of one of the said subsquares.

12. A heat exchanger as in claim 2 further including splitter members mounted between each two of said adjacent tubes at alternately opposite ends of said sheets, each of said splitter members comprising a plurality of concentric, semi-circular members defining a plurality of flow paths between said plurality of concentric, semi-circular members.

13. A heat exchanger as in claim 12 wherein each successive pair of said sheets are spaced at a distance of from about 0.5 to about 1.5 inch.

14. A heat exchanger as in claim 13 further comprising a plurality of regularly staggered angular members, each of said members comprising a generally horizontal portion securely mounted on each of said sheets and an integral, generally upright portion which rests snugly against the next higher sheet.

15. A heat exchanger as in claim 12 further comprising a plurality of regularly staggered angular members, each of said members comprising a generally horizontal portion securely mounted on each of said sheets and an integral, generally upright portion which rests snugly against the next higher sheet.

16. A heat exchanger as in claim 2 wherein each successive pair of said sheets are spaced at a distance of from about 0.5 to about 1.5 inch.

17. A heat exchanger as in claim 16 further comprising a plurality of regularly staggered angular members, each of said members comprising a generally horizontal portion securely mounted on each of said sheets and an integral, generally upright portion which rests snugly against the next higher sheet.

18. A heat exchanger as in claim 2 further comprising a plurality of regularly staggered angular members, each of said members comprising a generally horizontal portion securely mounted on each of said sheets and an integral, generally upright portion which rests snugly against the next higher sheet.

19. A heat exchanger as in claim 2 wherein said sheets are impressed with regularly repeating patterns, wherein each portion of the pattern is a repetition of a particularly shaped square comprising four sub-squares having indented and protruding portions as viewed from either side of the sheet; each of said squares comprising a series of indentations and protrusions in the form of a first elongated protrusion having a first centerline; a second elongated protrusion having a second centerline perpendicular to said first centerline of said first protrusion and spaced therefrom about one-half the length of said first protrusion; a third elongated protrusion having a third centerline which is perpendicular to said second centerline of said second protrusion and spaced therefrom about one-half the length of said second protrusion; a fourth elongated protrusion having a fourth centerline which is perpendicular to said third centerline of said third protrusion and spaced therefrom by about one-half the length of said third protrusion; and wherein said fourth centerline is spaced from said first centerline by about one-half the length from said first protrusion and wherein each of said elongated protrusion form the bisectors of one of the said subsquares.

* * * * *